United States Patent [19]

Manokhin et al.

[11] 4,187,898

[45] Feb. 12, 1980

[54] MANDREL FOR USE IN CONTINUOUS CASTING OF HOLLOW INGOTS

[76] Inventors: Anatoly I. Manokhin, ulitsa Metallurgov, 4, kv. 44; Anatoly G. Sitnov, ulitsa Metallurgov, 80a, kv. 42, both of Tula; Vitaly Y. Genkin, Sirenevy bulvar, 27, korpus 3, kv. 27; Anatoly L. Liberman, mikroraion Teply Stan, korpus 65, kv. 259, both of Moscow, all of U.S.S.R.

[21] Appl. No.: 882,901

[22] Filed: Mar. 1, 1978

[30] Foreign Application Priority Data

Mar. 3, 1977 [SU] U.S.S.R. ..... 2458622

[51] Int. Cl.[2] ..... B22D 11/04

[52] U.S. Cl. ..... 164/421; 164/85

[58] Field of Search ..... 164/85, 421, 422; 264/173, 209

[56] References Cited

U.S. PATENT DOCUMENTS

| | | | |
|---|---|---|---|
| 3,746,077 | 7/1973 | Lohikoski et al. | 164/421 |
| 3,886,996 | 6/1975 | Tseitlin et al. | 164/421 X |

FOREIGN PATENT DOCUMENTS

| | | | |
|---|---|---|---|
| 422522 | 10/1974 | U.S.S.R. | 164/421 |

*Primary Examiner*—Robert D. Baldwin
*Assistant Examiner*—Gus T. Hampilos
*Attorney, Agent, or Firm*—Haseltine, Lake & Waters

[57] ABSTRACT

A mandrel for continuous casting of hollow ingots comprising a hollow rod having a collar and a tapered portion thereof introduced into a mold cavity. Mounted on the collar is a protective sleeve axially movable along the rod under the hollow action of a drive mechanism. This makes it possible to eliminate the possibility of bridging formed in the continuously cast ingot in the event of an emergency.

8 Claims, 2 Drawing Figures

MANDREL FOR USE IN CONTINUOUS CASTING OF HOLLOW INGOTS

BACKGROUND OF THE INVENTION

1. Field of the Invention

The present invention relates to the continuous casting of metal, and more particularly, to a mandrel for use in the continuous casting of hollow ingots.

The invention is particularly applicable to continuous casting of hollow ingots of from 270 to 750 mm in outside diameter and from 100 to 350 mm in inside diameter. Additionally, the invention is readily applicable to the continuous casting of hollow ingots from carbon and alloy steels of larger diameter.

2. Background

In modern practice there is a strong trend towards utilization of mandrels made in the form of hollow rods for use in the continuous casting of hollow ingots.

It has been observed that metal penetration into the interior of the hollow ingot being cast is possible in the process of casting. Therefore, temperature transducers are mounted on inlet and outlet pipes through which passes water for cooling a mandrel, whereby the water temperature gradient is controlled throughout the casting process. Shortly after the beginning of the ingot withdrawal cycle, the temperature gradient increases to a prescribed value which depends upon the mandrel construction, consumption of the coolant used and on various other factors. An increase in the temperature gradient of the cooling water above the prescribed level indicates rupture of the ingot crust formed on the mandrel; this being a signal to discontinue the withdrawal operation.

It has been found in the course of continuous casting of steel hollow ingots, that the control method mentioned above makes it possible to reliably detect the rupture of the ingot internal crust and to minimize occurrences of metal penetration into the ingot interior. On the other hand, the termination of the withdrawal operation results in the adherence of the ingot internal crust to the mandrel surface, whereby bridging is formed thereon.

To avoid the bridging phenomenon, the mandrel is formed with openings for the passage of gases to cut through the ingot crust which envelops the mandrel. Though such construction permits the ingot crust to be removed from the mandrel, it still fails to allow the casting process to be resumed.

Summary of the Invention

An object of the invention is to provide a mandrel for use in the continuous casting of hollow ingots, wherein a hollow rod is constructed so as to eliminate the possibility by bridging formed of the ingot crust during continuous casting in the event of an emergency and to stabilize the process of continuous casting of hollow ingots.

This object is attained by the provision of a mandrel for use in continuous casting of hollow ingots, comprising a hollow rod fixed in a support member and having a collar and a tapered portion introduced into the mold cavity, wherein, according to the invention, a protective sleeve is fitted on the collar of the hollow rod, said sleeve being axially movable along the rod under the action of a drive mechanism.

Such mandrel construction makes it possible to eliminate occurrences of ingot crust bridging in an emergency during cooling of the hot hollow ingot enveloping the mandrel, since contact is prevented in the area of the metal meniscus between the solidified crust formed on the ingot inner surface and the mandrel, while shrinkage forces created by the cooling ingot are resisted by the protective sleeve.

According to the invention, the protective sleeve can be formed of two parts interconnected by a split collar spring and fitted with lugs in contact with the support member and spaced diammetrically opposite each other. The fact that the sleeve is constructed of two parts interconnected by the split collar spring makes for its easy mounting on the mandrel and allows the sleeve to be fixed on the cylindrical surface thereof.

The drive mechanism according to the invention preferably comprises air cylinders having pistons whose rods are brought into contact with the lugs of the protective sleeve, the chambers of said air cylinders communicating with a source of compressed air through channels provided for the purpose. The use of air cylinders as the driving mechanism is dictated by the necessity of taking safety measures in the zone of molten metal. In the event of employing a hydraulic drive there is a danger of oil getting on the molten metal. In addition, the use of a pneumatic mechanism is advantageous in that it permits the force created thereby to be instantaneously transmitted to enable rapid transfer of the protective sleeve to the zone the metal meniscus.

BRIEF DESCRIPTION OF THE DRAWINGS

The invention will be further described, by way of example only, with reference to the accompanying drawings, in which.

DETAILED DESCRIPTION OF THE PREFERRED EMBODIMENT

Figure 1:
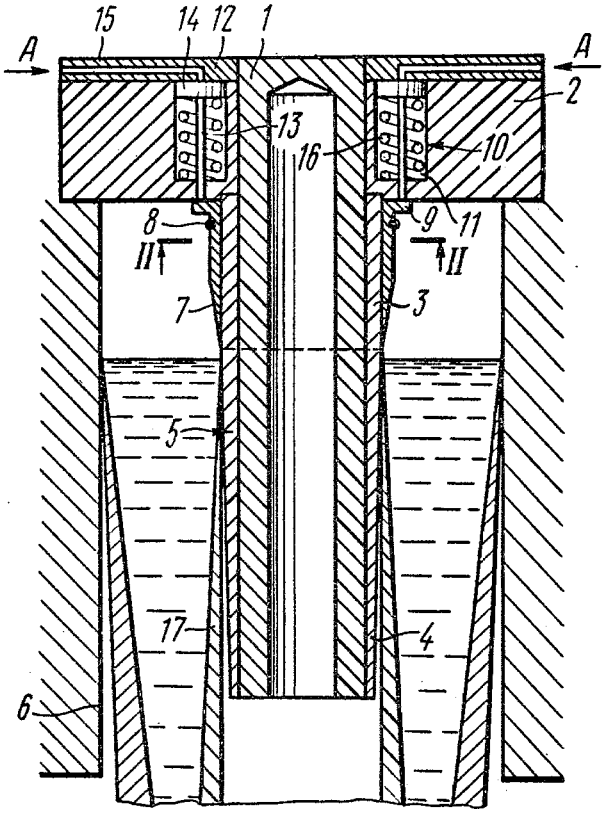
FIG. 1 is a longitudinal sectional view of a mandrel for use in the continuous casting of hollow ingots.
Figure 2:
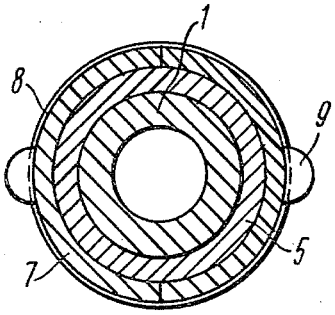
FIG. 2 is a cross-section taken along line II—II in FIG. 1.

Referring now to the drawings and to FIG. 1 in particular, there is shown therein the mandrel of the invention which comprises a hollow rod 1 fixed in a support member 2 and having a collar 3 and a tapered portion 4. The collar 3 and tapered portion 4 are formed as a copper case 5 fitted on the hollow rod 1, and are introduced into the cavity of a mold 6. Mounted on the collar 3 is a protective sleeve 7 made up of two parts interconnected by means of a split collar spring 8. Bath parts of the sleeve 7 are formed with lugs 9 in contact with the support member 2 and in diametrically opposite spaced relationship to each other. The sleeve 7 is mounted so as to be movable along the longitudinal axis of a drive mechanism which comprises air cylinders 10 formed by chambers 11 in the support member 2 and by a cover 12. The air cylinders have rods 13 connected to pistons 14 and the rods 13 are in contact with the lugs 9. The chambers 11 are connected to a source of compressed air (not shown) through channels 15 in the cover 12. The direction in which compressed air is supplied to the air cylinders is indicated in the drawing by arrow A. Mounted in the chambers 11 are springs 16 adapted to return the pistons 14 to their original position.

The mandrel according to the invention operates in the following manner.

In the process of metal casting, a crust 17 of solidifying metal is formed at the inner surface of the tapered portion 4 of the case 5. In the event of an emergency, the withdrawal operation is discontinued as compressed air is concurrently passed through the channels 15 to the chambers 11. The pistons 14 are thereby actuated and the rods 13 displace the protective sleeve 7 into the area of contact of the tapered portion 4 of the copper case 5 with the ingot being cast. During an idling period of the continuous casting apparatus, shrinkage forces of the solidifying crust 17 formed on the hollow ingot are resisted by the protective sleeve 7 which is made from the same material as the continuously cast ingot. After the emergency is eliminated, the withdrawal of the ingot is resumed.

We claim:

1. The combination of a continuous casting mold, a support member associated with said mold for supporting a mandrel and a mandrel supported by said support member and depending into said mold to define a hollow casting cavity for continuously casting hollow ingots, said mandrel comprising: a hollow rod having one end fixed in said support member; a collar formed around said hollow rod including an upper portion and a tapered lower portion; said tapered lower portion being tapered in narrowing fashion in the direction along the length of said hollow rod and travelling away from said fixed end; a protective sleeve mounted around said collar for movement along the axis of said hollow rod; and drive means associated with said support and said sleeve for displacing the sleeve relative to the hollow rod and the collar and tapered portion combination.

2. The combination as claimed in claim 1, wherein said sleeve comprises two parts interconnected by a split collar spring and including lugs in contact with the support member in diametrically opposite spaced relationship to each other.

3. The combination as claimed in claim 1, wherein said drive means comprises air cylinders including pistons having rods in contact with said lugs of said sleeve, said air cylinders having chambers communicating with a source of compressed air.

4. The combination as claimed in claim 1 wherein said support member is provided with channels for conveying compressed air from said source to said air cylinders.

5. The combination as claimed in claim 1 wherein said collar constitutes a case fitted on said hollow rod.

6. The combination as claimed in claim 5 wherein said case is made of copper.

7. The combination as claimed in claim 1 wherein said sleeve has a tapered lower end which tapers in the direction of the tapes of said tapered lower portion of said collar.

8. The combination as claimed in claim 7 wherein said sleeve is made from the same material as the continuously cast ingot.

* * * * *